United States Patent [19]

Varwig

[11] 4,074,815

[45] Feb. 21, 1978

[54] TURN-OVER COOLING BED FOR BAR-SHAPED ROLLED MATERIAL, PARTICULARLY BILLETS

[75] Inventor: Karlheinz Varwig, Mulheim, Germany

[73] Assignee: DeMag Aktiengesellschaft, Duisburg, Germany

[21] Appl. No.: 657,857

[22] Filed: Feb. 13, 1976

[30] Foreign Application Priority Data

Feb. 18, 1975 Germany ..... 2506703

[51] Int. Cl.[2] ..... G65G 7/00

[52] U.S. Cl. ..... 214/1 QG; 198/413

[58] Field of Search ..... 198/410, 409, 413, 774; 214/1 Q, 1 QG, 1 P, 1 PB; 72/252; 51/215 CP, 215 H

[56] References Cited

U.S. PATENT DOCUMENTS

| | | | |
|---|---|---|---|
| 1,027,124 | 5/1912 | Griffith | 198/774 |
| 2,112,075 | 3/1938 | DeMatteis et al. | 198/774 X |
| 3,042,226 | 7/1962 | Maciejczak | 214/1 QG |
| 3,554,363 | 1/1971 | Elineau | 198/774 |
| 3,648,827 | 3/1972 | Gipperich et al. | 198/774 |

FOREIGN PATENT DOCUMENTS

| | | | |
|---|---|---|---|
| 1,312,761 | 11/1962 | France | 72/252 |

*Primary Examiner*—Frank E. Werner
*Attorney, Agent, or Firm*—Mandeville and Schweitzer

[57] ABSTRACT

A cooling bed device is provided for straight-edged rolled material, such as billets, for example, for simultaneously conveying and turning the billets over the bed. This is achieved by a dual rake arrangement for engaging and moving the billets with a stationary rake cooperating with a movable rake. The movable rake is arranged to have a circular movement in a path parallel with the stationary rake. The teeth of both rakes are arranged to have the angle of inclination from horizontal of the rising flanks and falling flanks the same for both rakes, with the rising flanks of both having a steeper incline than the falling flanks. Moreover, adjacent teeth in the stationary rake form angles of about 90° with each other, and adjacent teeth in the movable rake are spaced from each to form horizontal bearing surfaces wider than the longest straight edge of a billet to be handled. By utilizing a single movable rake movable in a simple circular path, and with the incline of rising and falling flanks of the teeth of both rakes being the same, the device is much less expensive to construct and operate, while still providing a full 90° turn-over of the billets in a single sequence of movement of the device.

2 Claims, 5 Drawing Figures

TURN-OVER COOLING BED FOR BAR-SHAPED ROLLED MATERIAL, PARTICULARLY BILLETS

BACKGROUND AND STATEMENT OF THE INVENTION

The invention covers a turn-over cooling bed for barshaped rolled material, particularly billets, with one stationary rake and one rake moving on a closed circular track, which transports the material while simultaneously turning it around its longitudinal axis.

The known rake cooling bed (DT-Gbm 1 993 913), particularly for heavy billets, is provided with rakes of different design. The rake teeth are arranged so that a billet is turned only by 45° during the course of one rake movement. The shape of the rake is very complicated and, therefore, difficult to manufacture.

Furthermore, a rake cooling bed for square material (DT-PS 1 265 695) is known consisting of two feed rakes swinging parallel in vertical direction. The rakes are equipped with triangular teeth, their flanks near the top of the teeth and at the base of the teeth being indented to catch the edges of the bars. This rake cooling bed, too, is provided with a very complicated type of rake and must, furthermore, be equipped with an additional gear mechanism as both rakes must be moved.

Based on the above, it is the object of this invention to improve upon a rake cooling bed of the initially described type, to provide simple structural means for safe and functional conveying of the bar profiles to be cooled using simple gears.

This is solved, in accordance with the invention, by providing the teeth of the stationary and the movable rakes with even inclination of their flanks and tooth division; by making the inclination of the flanks rising in conveying direction steeper than that of the dropping flanks; by having the tooth flanks of two adjacent teeth in the stationary rake form a tooth base angle of approximately 90°, and by providing an even horizontal bearing surface between two adjacent teeth of the movable rake, the width of such bearing surface being greater than the width of the largest piece of material to be conveyed.

The uniform flank inclination and division of the rake teeth considerably simplifies the construction of the rake cooling bed, particularly the production of the rakes. Nevertheless, the flank angles ensure safe turning and conveying, even of differential material dimensions.

In accordance with another detail of the invention, the simple construction makes if feasible to design the gear in such a manner that the path of the movable rake is circular. In the case of only one driven rake, the movement along a circular path means also a simplification of the cooling bed versus the present stage of technology.

DESCRIPTION OF THE DRAWINGS

An example of the invention is shown in the drawings, namely.

DETAILED DESCRIPTION OF THE INVENTION

Figure 1:
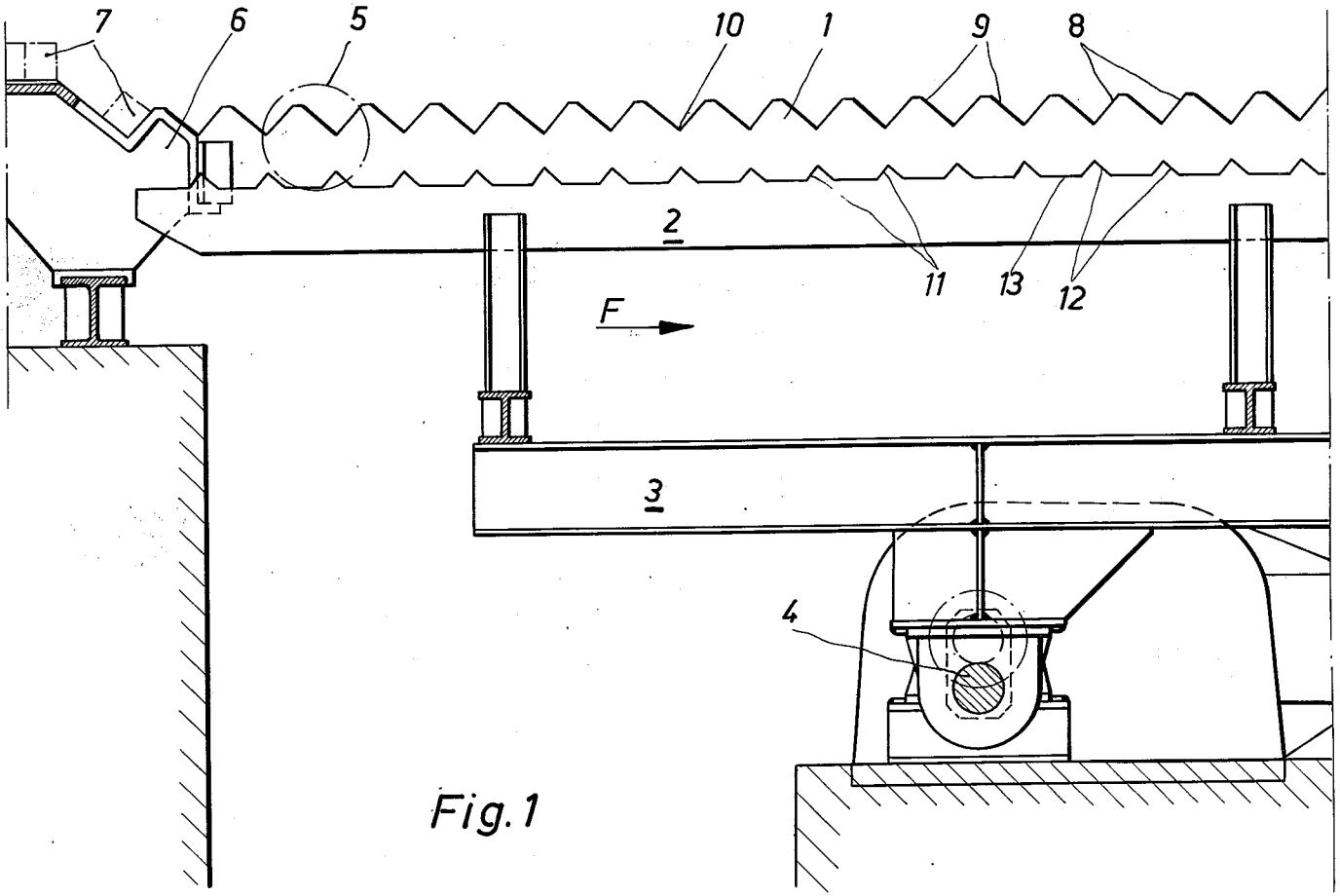
FIG. 1 shows a cross section of the rake cooling bed according to the invention.

In FIG. 1, the stationary rake of the cooling bed is represented by 1, the movable rake by 2. The movable rake part, together with frame 3, is moved along a circular path by gear 4, such circular path being indicated in dot-dash line at 5. 6 stands for the delivery device. Rakes 1 and 2 of the cooling bed are equipped with rake teeth, whereby the rake flanks rising in conveying direction are marked by 8, and the dropping flanks by 9. 10 stands for the tooth base formed by two adjacent teeth. Movable rake 2 is equipped with teeth of uniform flank inclination, whereby the rising flanks are indicated by 11 and the dropping flanks by 12. Level bearing surface 13, evening out the tooth base, is provided between two adjacent teeth of movable rake 2. The rising and dropping flanks 8, 9, 11, 12 of the rake teeth of both rakes 1, 2 run at right angles, however, the rising flanks 8, 11 are more steeply inclined that the dropping flanks 9, 12. The conveying direction of the cooling bed is indicated by F.

Figure 2:
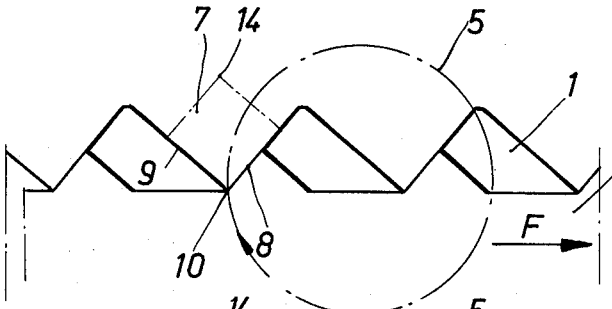
FIGS. 2–5 show the schematic course of a turning and conveying process.
Figure 3:
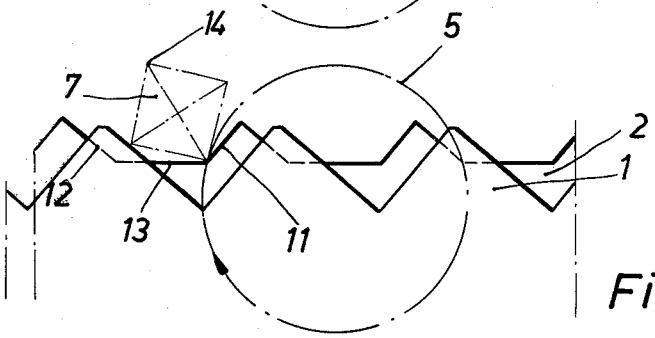
Figure 4:
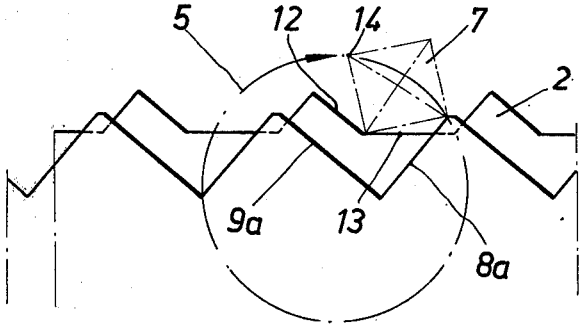
Figure 5:
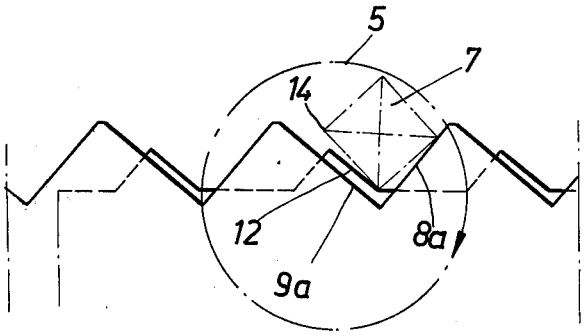

FIGS. 2 through 5 show the course of the turning process, while simultaneously conveying square billet 7 in individual steps. For purposes of clarification, the upper edge of the billet, as positioned in FIG. 2, is indicated by 14. In FIG. 2, billet 7 rests on flanks 8 and 9 of the stationary rake and the edge opposite edge 14 lies on tooth base 10 of rake 1. Movable rake 2 is drawn in its lowest position on circular path 5. Rake 2 moves along this circular path 5, as shown in FIG. 3, thus lifting the edge opposite edge 14 of billet 7 off the tooth base 10 of the stationary rake, whereby this edge is supported in the corner formed by flank 11 and level surface 13 of movable rake 2. Billet 7 is initially turned by 45° and positioned onto surface 13, its flat side touching, and lifted over the top of the rake tooth shown on the right-hand side of the drawing in the course of the continuing circular movement 5 of rake 2. FIG. 4 shows how billet 7, so far resting on surface 13, is then held, depending on the size of the billet, at its right-hand edge by an area of the rising flank 8*a* of the successive rake tooth, while movable rake 2 is lowered on its path. The opposite lower edge of billet 7 now rests in the corner formed by surface 13 and dropping flank 12 of movable rake 2. During further decline of movable rake 2, billet 7 is turned more, so that edge 14, turned by 90° compared to the position shown in FIG. 2, rests again on tooth base 10 of stationary rake 1, whereby the two lower sides of the billet touch flanks 8*a* and 9*a* of the space before the tooth following in conveying direction. This terminates the proposed turning process and billet 7 has been advanced in conveying direction F by one rake tooth. The steeper inclination of flanks 8 and/or 8*a* ensures that tilting of billet 7 is effected in the desired direction, namely, opposite the conveying direction.

I claim:

1. A cooling bed for simultaneously conveying and turning hot semi-soft straight-edged rolled material such as billets while maintaining continuous non-tumbling support thereof, the improvement comprising:

(a) a stationary rake with teeth;

(b) a movable rake with teeth;

(c) means connected to said movable rake for moving said movable rake parallel to the longitudinal axis of said stationary rake; characterized by (d) said moving means moving said movable rake in a closed circular path;

(e) the angle of inclination from horizontal of the rising flanks and falling flanks of the teeth of said movable and stationary rakes being the same;

(f) the angle of said rising flanks of said teeth being steeper than said falling flanks;

(g) the flanks of adjacent teeth in said stationary rake forming angles of about 90 degrees with each other;

(h) said teeth in said movable rake being spaced from each other to form horizontal bearing surfaces at the base of said teeth; and (i) said horizontal bearing surfaces being wider than the straight edges of the rolled material to be conveyed and turned;

(j) said horizontal bearing surfaces, together with said teeth in said movable and stationary rakes, providing continuous non-tumbling support of said semi-soft rolled material.

2. The apparatus of claim 1, further characterized by (a) the number and spacing of said teeth on said stationary and said movable rakes being equal.

* * * * *